US007002522B2

(12) United States Patent
Kim et al.

(10) Patent No.: US 7,002,522 B2
(45) Date of Patent: Feb. 21, 2006

(54) CHIP ANTENNA FOR TERRESTRIAL DMB

(75) Inventors: Hyun Hak Kim, Kyungki-do (KR); Chul Ho Kim, Kyungki-do (KR); Gi Tae Do, Kyungki-do (KR); Il Hwan Park, Kyungki-do (KR); Jeong Sik Seo, Daejeon (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 10/893,923

(22) Filed: Jul. 20, 2004

(65) Prior Publication Data

US 2005/0259012 A1 Nov. 24, 2005

(30) Foreign Application Priority Data

May 21, 2004 (KR) ..... 10-2004-0036502

(51) Int. Cl.
*H01Q 1/24* (2006.01)

(52) U.S. Cl. ..... 343/702; 343/895

(58) Field of Classification Search ..... 343/702, 343/895, 700 MS, 873
See application file for complete search history.

(56) References Cited

U.S. PATENT DOCUMENTS 5,798,737 A * 8/1998 Kanaba et al. ..... 343/895
6,028,568 A * 2/2000 Asakura et al. ..... 343/895
6,075,491 A 6/2000 Dakeya et al. ..... 343/702
6,396,460 B1 5/2002 Tseng et al. ..... 343/895
6,583,769 B1 * 6/2003 Shiroki et al. ..... 343/895
2004/0119653 A1 6/2004 Asakura et al. ..... 343/702

FOREIGN PATENT DOCUMENTS

| | | |
|---|---|---|
| GB | 2349277 | 10/2000 |
| JP | 2000-59125 | 2/2000 |
| JP | 2003-209422 | 7/2003 |
| WO | WO 2004/040691 | 5/2004 |

* cited by examiner

*Primary Examiner*—Hoang V. Nguyen
(74) *Attorney, Agent, or Firm*—Lowe Hauptman & Berner, LLP

(57) ABSTRACT

Disclosed herein is a chip antenna for terrestrial DMB. The chip antenna comprises a dielectric block, a main antenna device formed with conductive patterns in the dielectric block such that a plurality of unit lamination structures of the conductive patterns having a meander line structure in the direction of the Z-axis in an XZ plane are arranged in the direction of the Y axis while adjacent unit lamination structures are connected to each other, forming a lamination structure having the meander line structure in the directions of the Y-axis, and the plurality of lamination structures are arranged in the direction of the X-axis and adjacent lamination structures are connected to each other in the direction of the X-axis to have the meander line structure, and a T-shaped assistant antenna device formed at an upper or lower dielectric layer in the main antenna device.

11 Claims, 9 Drawing Sheets

CHIP ANTENNA FOR TERRESTRIAL DMB

RELATED APPLICATIONS

The present application is based on, and claims priority from, Republic of Korea Application Serial Number 2004-36502, filed May 21, 2004, the disclosure of which is hereby incorporated by reference herein in its entirety.

BACKGROUND OF THE INVENTION

1. Field of the Invention

The present invention relates to a chip antenna for terrestrial digital multimedia broadcasting (DMB), and particularly to a chip antenna for terrestrial DMB, which is minimized to a chip-shape antenna by an LTCC (Low Temperature Cofired Ceramics) process and realizes a widened bandwidth using various dissipative structures of current distribution, so that the antenna can be stored in a personal digital assistant (PDA) and can provide a wide band adequate for receiving the terrestrial DMB.

2. Description of the Related Art

Generally, the term "digital multimedia broadcasting (DMB)" means a broadcasting system, which can transmit characters, graphics, moving images as well as voice data having a high, compact disk-quality level, without being limited to simple audio services, such as the existing AM broadcasting or FM broadcasting. Typically, although the DMB indicates a terrestrial broadcasting system, which offers free services on the air in a local area, broadly speaking, it comprises satellite digital audio broadcasting (DAG), which offers fee-based services on the air, concurrently using a space system and a ground network.

Moreover, the DMB is an audio broadcasting system completely different from the existing analog voice processing system and the existing modulation system. Specifically, as for a main broadcasting system, the DMB adopts a digital voice processing system and a digital modulation system having a strong point in noise or deterioration as a modulation system. As the voice processing system, the DMB adopts an audio compression system of MPEG I Layer 2, which compresses a huge amount of data to be suitable for sending and storing, and as the modulation system, it adopts a COFDM (Corded Orthogonal Frequency Division Multiplexing) system, which is excellent in moving object receiver capability.

The DBM has an usable frequency of about 174~240 MHz in a band-III and of about 1,452~1,492 MHz in a band-L. Thus, for instance, when realizing a $\lambda/4$ antenna of 200 MHz, the antenna must have a straight line length of about 37 cm (1.5M/4).

A conventional antenna for the terrestrial DMB is shown in FIG. 1.

FIG. 1 is a diagram illustrating an appearance of the conventional chip antenna for the terrestrial DMB. The conventional chip antenna for the terrestrial DMB shown in FIG. 1 is an antenna enabling analog/digital television broadcasting in a VHF/UHF bandwidth to be watched in a vehicle or room. Referring to FIG. 1, the conventional chip antenna for the terrestrial DMB has a structure modified from a ½-wavelength dipole antenna, in which a radiator of the dipole antenna is formed of a strip line and folded to make creases in a zigzag, thereby realizing miniaturization of the antenna and a wide bandwidth.

Nevertheless, in view of the fact that the manufactured antenna in practice has a length of about 44 cm, the conventional antenna has a problem in that the antenna is too large to be stored in the PDA or a DMB terminal.

Additionally, since the minimization of the antenna causes a problem of a narrowed band, it is necessary to overcome the problem of the narrowed band caused by the minimized antenna.

SUMMARY OF THE INVENTION

The present invention has been made to solve the above problems, and it is an object of the present invention to provide a chip antenna for terrestrial DMB, which is minimized to a chip-shape antenna by an LTCC process and realizes a widened bandwidth using various dissipative structures of current distribution, so that the antenna can be stored in PDAs and can provide a wide band adequate for receiving the terrestrial DMB.

In accordance with one aspect of the present invention, the above and other objects can be accomplished by the provision of a chip antenna for terrestrial DMB, comprising: a dielectric block with a plurality of dielectrics having an XY plane laminated in the direction of the Z-axis therein; a main antenna device formed with conductive patterns in the dielectric block such that a plurality of unit lamination structures of the conductive patterns having a meander line structure in the direction of the Z-axis in an XZ plane are arranged in the direction of the Y axis and adjacent unit lamination structures are connected to each other, forming a lamination structure having the meander line structure in the direction of the Y-axis, and the plurality of lamination structures are arranged in the direction of the X-axis and adjacent lamination structures are connected to each other in the direction of the X-axis to have the meander line structure; and a T-shaped assistant antenna device formed at an upper or lower dielectric layer in the main antenna device while being connected to one end of the main antenna device through a conductive via-hole so that the assistant antenna device dissipates current distribution of the main antenna device, thereby widening bandwidth.

In accordance with another aspect of the present invention, there is provided a chip antenna for terrestrial DMB, comprising: a dielectric block with a plurality of dielectrics having an XY plane laminated in the direction of the Z-axis therein; a main antenna device formed with conductive patterns to form meander line structures in the directions of the X-axis, the Y-axis and the Z-axis, respectively, in the dielectric block; and a T-shaped assistant antenna device formed at an upper or lower dielectric layer in the main antenna device while being connected to one end of the main antenna device through a conductive via-hole so that the assistant antenna device dissipates current distribution of the main antenna device, thereby widening bandwidth.

The main antenna device may have a resonance length corresponding to a frequency of the terrestrial DMB.

The assistant antenna device may comprise a plurality of patterns having a length gradually increasing from one side of the main antenna toward the other side of the main antenna, respectively.

BRIEF DESCRIPTION OF THE DRAWINGS

The foregoing and other objects and features of the present invention will be more clearly understood from the following detailed description taken in conjunction with the accompanying drawings, in which.

DESCRIPTION OF THE PREFERRED EMBODIMENTS

Figure 1:
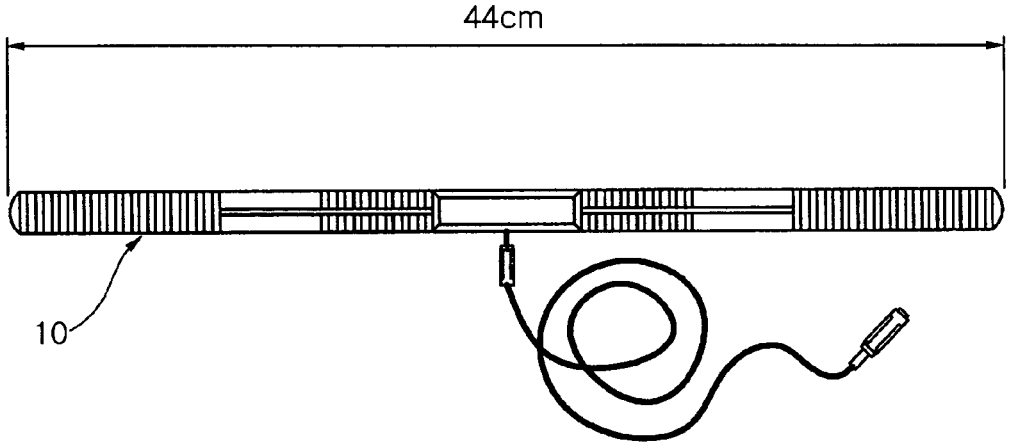
Prior art FIG. 1
FIG. 1 is a diagram illustrating an appearance of a conventional chip antenna for terrestrial DMB.

Preferred embodiments will now be described in detail with reference to the accompanying drawings. Like components, which have substantially identical structures and functions, will be denoted by like reference numerals.

Figure 2:
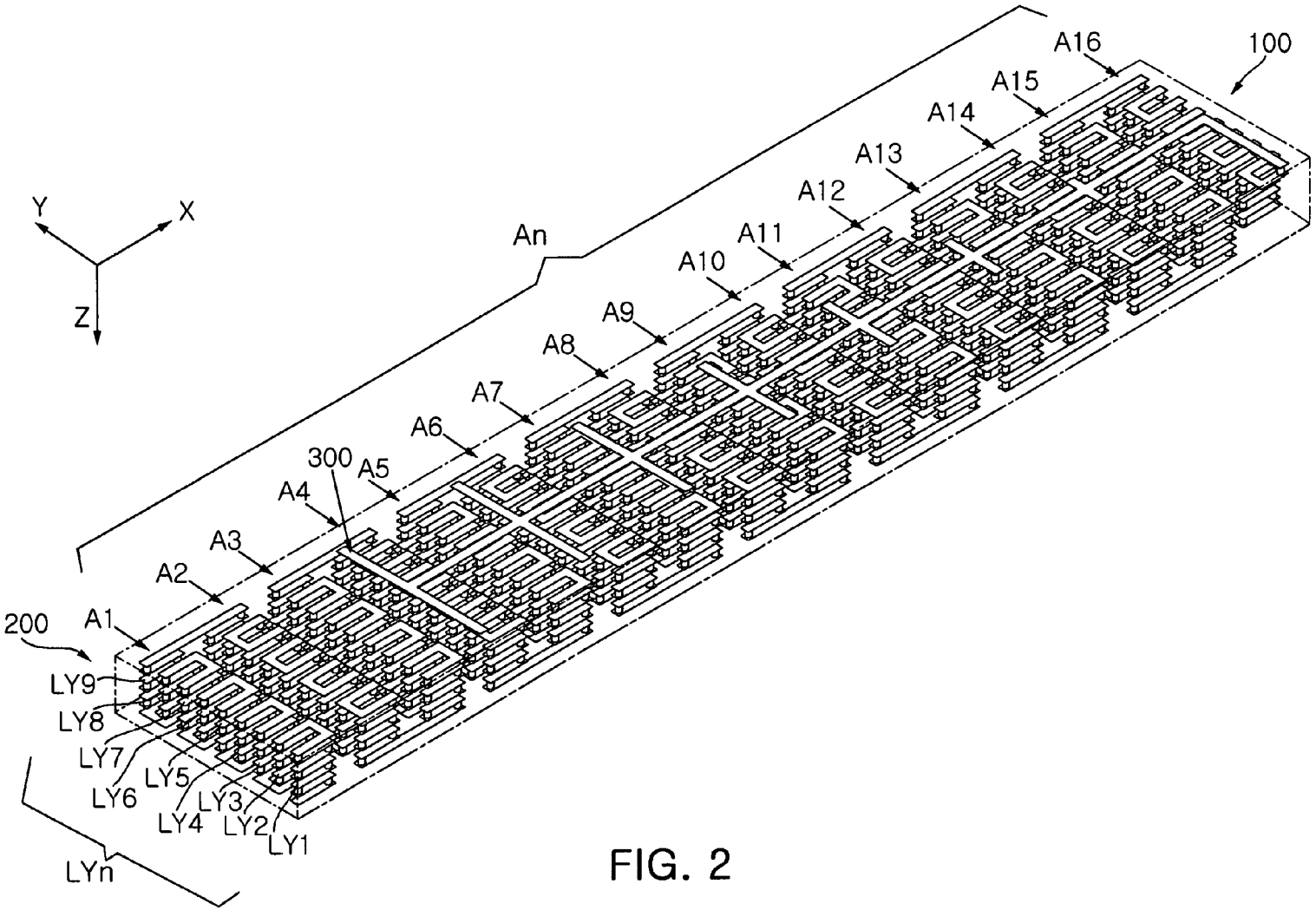
FIG. 2 is a perspective view of a chip antenna for terrestrial DMB according to the present invention.
Figure 3:
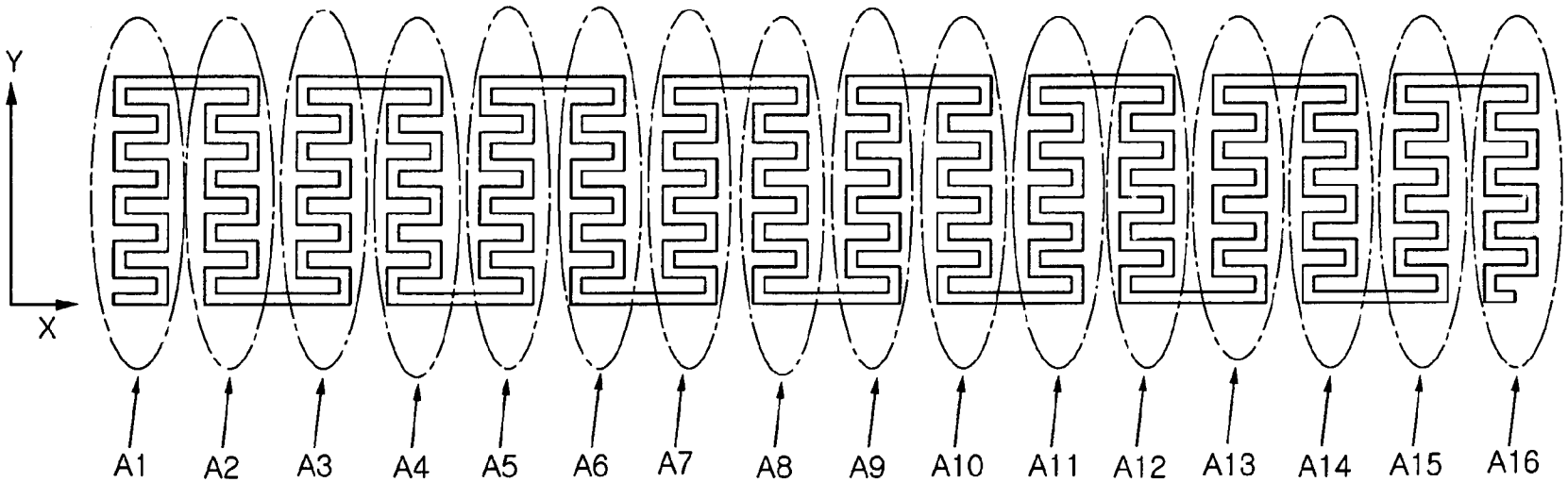
FIG. 3 is a plan view of a main antenna device of the chip antenna for the terrestrial DMB according to the present invention.

FIG. 2 is a perspective view of a chip antenna for terrestrial DMB according to the present invention, and FIG. 3 is a plan view of a main antenna device of the chip antenna for the terrestrial DMB according to the present invention.

Referring to FIGS. 2 and 3, the chip antenna for the terrestrial antenna comprises: a dielectric block 100 with a plurality of dielectrics having an XY plane laminated in the direction of the Z-axis therein and being formed according to an LTCC process; a main antenna device 200 formed in the dielectric block 100 with conductive patterns to form a meander line structure in the directions of the X-axis, the Y-axis and the Z-axis, respectively; and a T-shaped assistant antenna device 300 formed at an upper or lower dielectric layer in the main antenna device 200 while being connected to one end of the main antenna device 200 through a conductive via-hole so that the assistant antenna device 300 dissipates current distribution of the main antenna device, thereby widening bandwidth.

Here, the main antenna device 200 has a resonance length corresponding to a frequency of the terrestrial DMB, and the T-shaped assistant antenna device 300 has a dissipative structure of the current distribution for widening the bandwidth.

Figure 4:
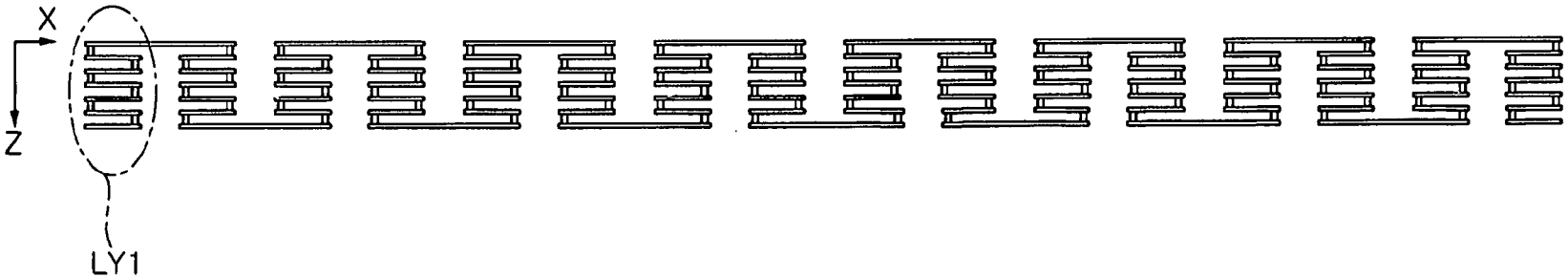
FIG. 4 is a plan view of a main antenna device of the chip antenna for the terrestrial DMB according to the present invention.
Figure 5:
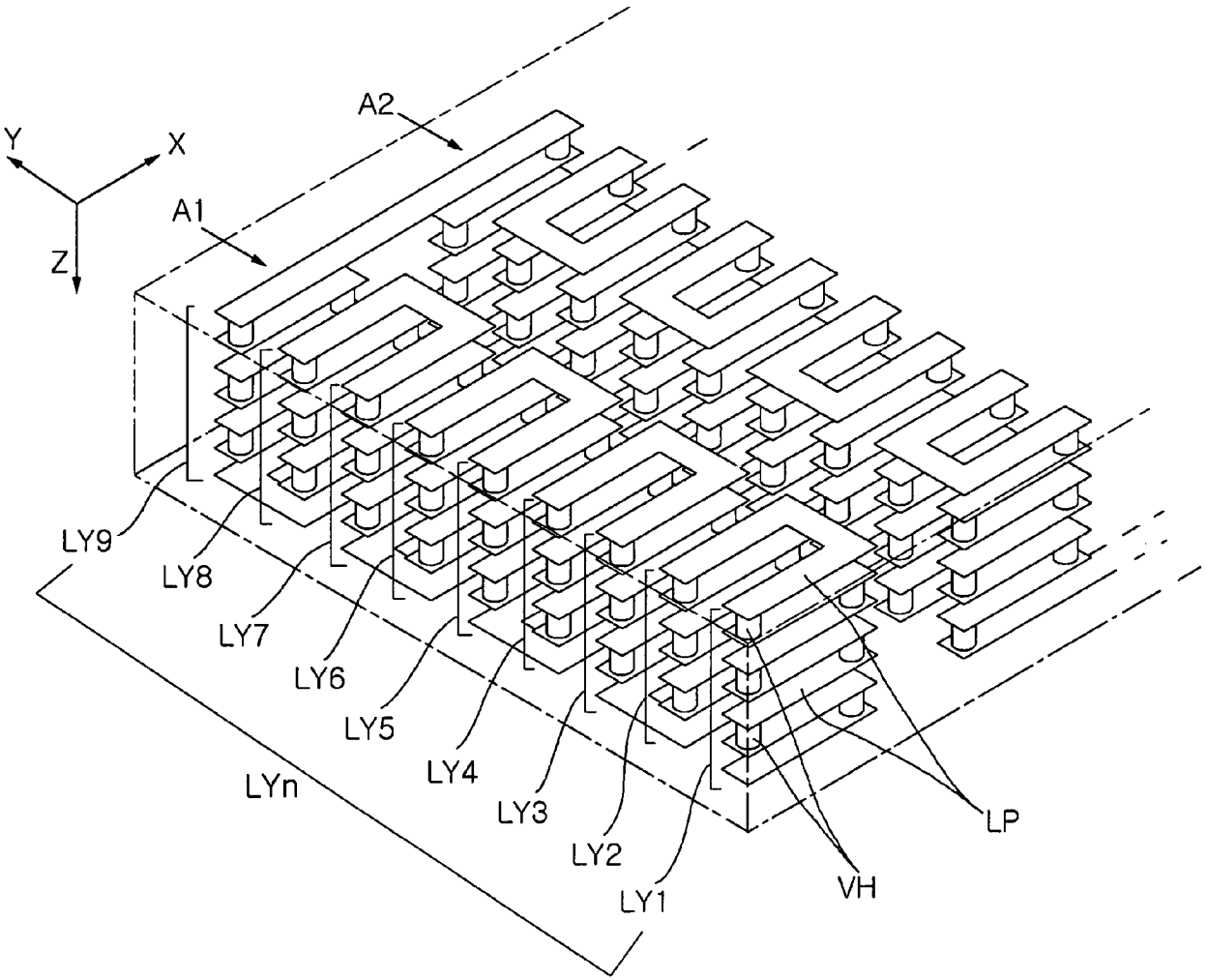
FIG. 5 is a partially enlarged perspective view of a laminated structure of the chip antenna for the terrestrial DMB according to the present invention.

In the dielectric block 100 with a plurality of dielectrics having an XY plane laminated in the direction of the Z-axis therein, the main antenna device 200 is formed with conductive patterns such that a plurality of unit lamination structures LYn of the conductive patterns having a meander line structure in the direction of the Z-axis in an XZ plane are arranged in the direction of the Y axis and adjacent unit lamination structures are connected to each other, forming a lamination structure An having the meander line structure in the directions of the Y-axis, and the plurality of lamination structures An are arranged in the direction of the X-axis and adjacent lamination structures are connected to each other in the direction of the X-axis to have the meander line structure FIG. 4 is a plan view of the main antenna device of the chip antenna for the terrestrial DMB according to the present invention, and FIG. 5 is a partially enlarged perspective view of a laminated structure of the chip antenna for the terrestrial DMB according to the present invention.

Referring to FIGS. 3 to 5, the main antenna device 200 of the chip antenna for the terrestrial DMB comprises the plurality of lamination structures An (A1 to A16), and each of the plurality of lamination structures An (A1 to A16) comprises the plurality of unit lamination structures LYn (LY1 to LY9).

The plurality of lamination structures A1 to A16 are connected to each other in such a manner that the adjacent lamination structures at one side of the lamination structure are connected to each other through the uppermost outer conductive line pattern LP at one side thereof, and the next adjacent lamination structures at the other side thereof are connected to each other through the lowermost outer conductive line pattern LP at the other side thereof, thereby forming a spatial meander line structure in the direction of the X-axis as shown in FIG. 3.

Further, each of the plurality of unit lamination structures LY1 to LY9 comprises: a plurality of conductive line patterns LP, each having a predetermined length in the direction of the X-axis, on each of the dielectric layers laminated in the vertical direction inside the dielectric block 100; and a plurality of conductive via-holes VH for connecting the conductive line patterns adjacent to each other in the vertical direction among the plurality of conductive line patterns LP to have the meander line structure.

Further, as shown in FIG. 5, the plurality of unit lamination structures LY1 to LY9 are connected to each other in one lamination structure, for example A1, in such a manner that the adjacent unit lamination structures at one side of the unit lamination structures are connected to each other through one end of the lowermost conductive line pattern LP at one side thereof, and the next adjacent lamination structures at the other side thereof are connected to each other through the other end of the uppermost conductive line pattern LP at the other side thereof.

Thus, each of the plurality of unit lamination structures LYn forms the meander line structure in the direction of the Z-axis as shown in FIG. 5.

Meanwhile, referring to FIG. 5, in one lamination structure An, the conductive line patterns LP of a first unit lamination structure LY1 are formed from a first layer to a seventh layer of the dielectric layers while being connected to each other by the conductive via-holes to have the meander line structure. Here, the conductive line pattern LP of the seventh layer in the first unit lamination structure LY1 is connected to the conductive line pattern LP of the seventh layer in a second unit lamination structure LY2.

The conductive line patterns LP of the second unit lamination structure LY2 are formed from the first layer to the seventh layer while being connected to each other by the conductive via-holes to have the meander line structure. The conductive line pattern LP of the first layer in the second unit lamination structure LY2 is connected to the conductive line pattern LP of the first layer in a third unit lamination structure LY3.

The conductive line patterns LP of the third unit lamination structure LY3 are formed from the first layer to the seventh layer while being connected to each other by the conductive via-holes to have the meander line structure. The conductive line pattern LP of the seventh layer in the third unit lamination structure LY3 is connected to the conductive line pattern LP of the seventh layer in a forth unit lamination structure LY4.

As such, each of the plurality of unit lamination structures LYn forms the meander line structure in the direction of the Z-axis, and in one lamination structure An, the adjacent unit lamination structures LYn form the meander line structure in the direction of the Y-axis, thereby providing the lamination structure An. Further, adjacent lamination structures An (A1 to A16) form the spatial meander line structure in the direction of the X-axis, thereby forming the main antenna device 200.

Meanwhile, in order to realize a λ/4 antenna of 170 MHz in a VHF band, there is a need to provide an antenna having a length of at least 441 mm (¼ wavelength; 170 MHz). Further, in order to realize the chip antenna having a dimension of 50×8×2 $mm^3$ under consideration of the above length, a plurality of dielectric layers, for example, the conductive line patterns constituting each of the unit lamination structure LYn in the lamination structure An are connected from the first layer to the seventh layer to each other using the conductive via-holes VH to form the meander line structure.

Each of the unit lamination structures LYn connected as described above is arranged to form the spatial meander line structure in the direction of the Y-axis as shown in FIG. 5, thereby forming the lamination structures A1 to A16. The lamination structures A1 to A16 are connected to form the spatial meander line structure in the direction of the X-axis as shown in FIG. 3, thereby forming the main antenna device 200.

As a result, the minimized chip antenna having the dimension of 50×8×2 $mm^3$ can realize a desired resonance length in the VHF band.

Here, the term "spatial meander line structure" means a meander line structure wherein one connecting pattern among the connecting patterns formed on both sides for connecting the conductive line patterns LP is formed on the first of the seven dielectric layers and the other connecting patterns is formed on the seventh dielectric layer.

Figure 6:
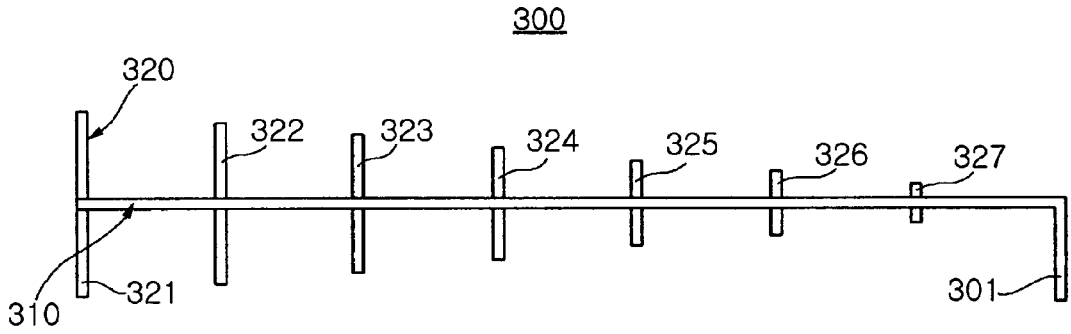
FIG. 6 is a plan view of an assistant antenna device of the chip antenna for the terrestrial DMB according to the present invention.
Figure 7:
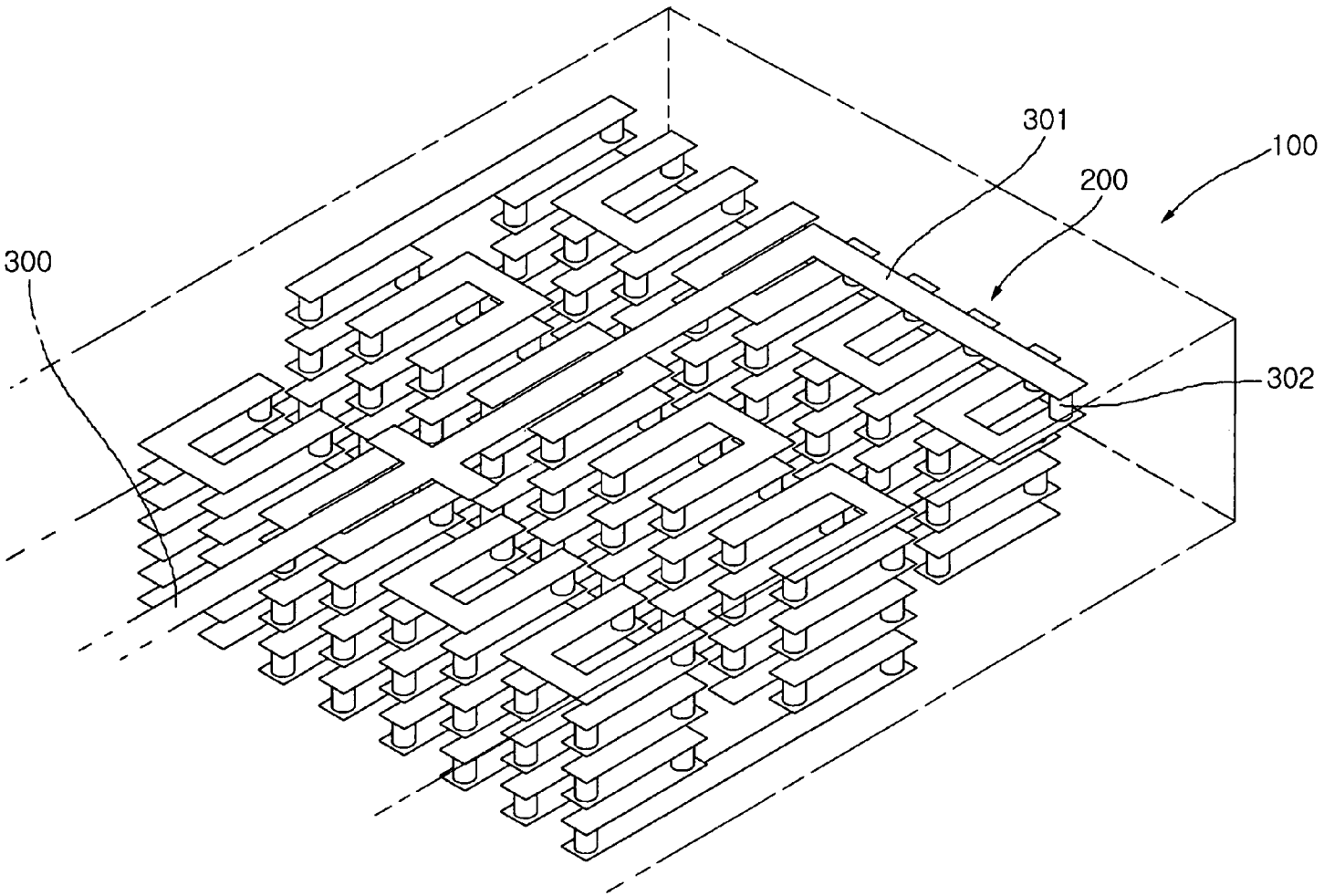
FIG. 7 is a perspective view illustrating a connected structure of the main antenna device and the assistant antenna device according to the present invention.

Mutual impedance between the conductive line patterns of each unit lamination structure can be optimized through experimentation by controlling a thickness between the ceramic layers having the conductive line patterns respectively arranged therein, and a problem of a decrease in bandwidth resulting from an increase of Q value caused by the miniaturization of the antenna can be enhanced using a T-shaped assistant antenna device 300 shown in FIGS. 6 and 7.

Widening of the bandwidth through dissipation of the current distribution will now be described with reference to FIGS. 6 and 7.

FIG. 6 is a plan view of an assistant antenna device of the chip antenna for the terrestrial DMB according to the present invention, and FIG. 7 is a perspective view illustrating a connected structure of the main antenna device and the assistant antenna device according to the present invention.

Referring to FIGS. 6 and 7, the assistant antenna device 300 is formed on the dielectric layer at an upper or lower side of the main antenna device 200 in the direction of the X-axis at a predetermined length, and comprises: a main pattern 310 with one end 301 of the main pattern 310 connected to one end of the main antenna device 200 through a conductive via-hole 302; and an assistant pattern 320 formed on the same dielectric layer as that of the main pattern 310 and having a plurality of patterns 321~327 connected with the main pattern 310 in the direction perpendicular to the main pattern 310 while being spaced from each other by a predetermined distance.

For instance, when the assistant antenna device 300 is formed at an eighth layer, the assistant antenna device 300 is connected with the conductive line patterns of the main antenna device 200 formed on the seventh dielectric layer.

Further, preferably, the assistant pattern 320 comprises the plurality of patterns 321~327 having a length gradually decreased in the direction from one side to the other side of the main antenna device, respectively. More preferably, the assistant pattern 320 comprises the plurality of patterns 321~327, of which a length is gradually decreased from one end 301 of the main pattern 310 connected to one end of the main antenna device 200 to the other end of the main pattern 310.

As a result, the T-shaped structure of the assistant antenna device 300 allows the current distribution to be dissipated, thereby widening the bandwidth.

Figure 8A:
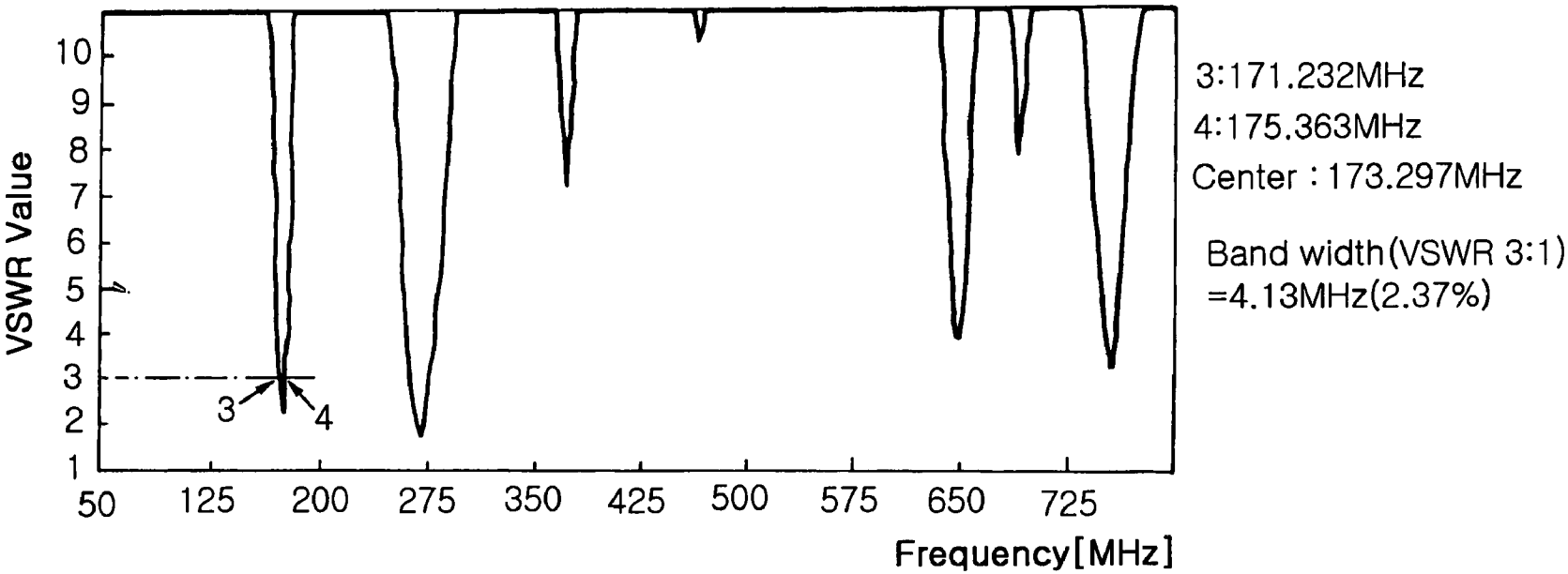
FIGS. 8*a* and 8*b* are graphical representations depicting VSWR characteristic of the chip antenna according to the present invention.
Figure 8B:
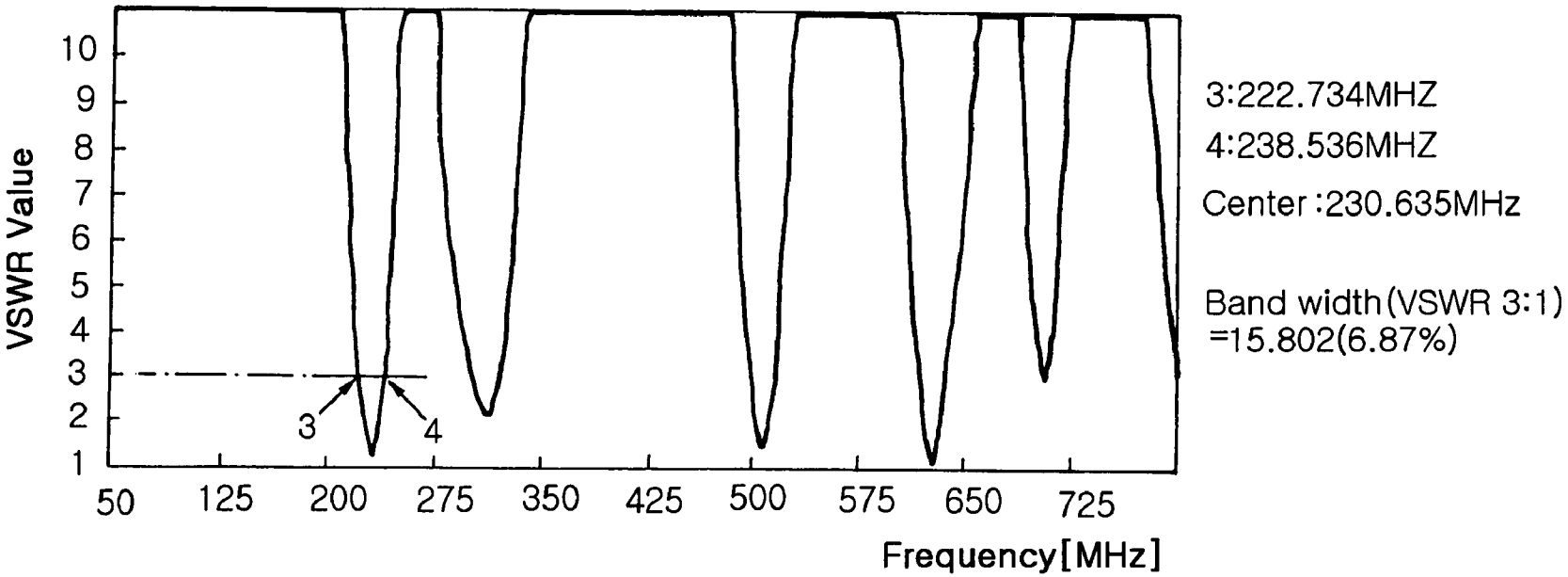

FIGS. 8*a* and 8*b* are graphical representations depicicting VSWR (Voltage Standing-Wave Ration) characteristics of the chip antenna according to the present invention.

FIG. 8*a* is graphical representation of the VSWR characteristics for explaining the bandwidth when the chip antenna is realized using the main antenna device without the assistant antenna device. FIG. 8*b* is graphical representation of the VSWR characteristics for explaining the bandwidth when the chip antenna is realized using the main antenna device coupled with the assistant antenna device.

Referring to FIG. 8*a*, when the T-shaped assistant antenna device as described above is not used, frequencies indicated by "3" and "4" at a point VSWR[3:] are 171.232 MHz and 175.363 MHz, respectively, and the bandwidth thereof is about 4.13 MHz. Further, dividing the bandwidth by 173.297 MHz produces a result of about 2.37%.

Meanwhile, referring to FIG. 8*b*, when the T-shaped the assistant antenna device is included, the frequencies indicated by "3" and "4" at a point VSWR[3:] are 222.734 MHz and 238.536 MHz, respectively, and the bandwidth thereof is about 6.87 MHz. Further, dividing the bandwidth by 230.635 MHz produces a result of about 6.87%.

According to the results, as the current distribution formed at one end of the antenna through the T-shaped assistant antenna device can be dissipated in the chip antenna of the present invention, the maximum VSWR can be enhanced to 6.8% (15.8 MHz) at the point of 3:1.

As described above, the chip antenna for the terrestrial DMB according to the present invention can be remarkably minimized to have the dimension of 50×8×2 $mm^3$ (length X width X thickness) according to the LTCC process, so that it can be easily stored in a small mobile communication terminal, and the problem of a narrowed band caused by the minimized antenna can be solved by realizing a relatively large bandwidth even in the minimized antenna using the dissipated structure of the current distribution.

Thus, the present invention minimizes the chip antenna capable of receiving Band III (170~210 MHz) frequencies of the DMB using the LTTC process, thereby enabling the chip antenna to be stored in the mobile communication terminal and the like, and provides a widened bandwidth (6.8%), compared with the dimensions of the antenna, using the dissipation of the current distribution at the distal end of the antenna. As a result, the chip antenna can be minimized to a dimension of about 2~3 cm, enabling the chip antenna to be stored in a terminal for a satellite DMB.

As apparent from the above description, according to the present invention, there are advantageous effects in that the chip antenna for the terrestrial DMB is minimized to have the chip shape using the LTTC process and the bandwidth is widened using the various dissipative structures of the current distribution, so that the chip antenna can be stored in the PDA and so that the wide band adequate for receiving the terrestrial DMB can be ensured.

It should be understood that the embodiments and the accompanying drawings as described above have been described for illustrative purposes and the present invention is limited by the following claims. Further, those skilled in the art will appreciate that various modifications, additions and substitutions are allowed without departing from the scope and spirit of the invention as set forth in the accompanying claims.

What is claimed is:

1. A chip antenna for terrestrial DMB, comprising:

a dielectric block with a plurality of dielectrics having an XY plane laminated in the direction of the Z-axis therein;

a main antenna device formed with conductive patterns in the dielectric block, such that a plurality of unit lamination structures of the conductive patterns having a meander line structure in the direction of the Z-axis in an XZ plane are arranged in the direction of the Y axis, adjacent unit lamination structures are connected to each other, forming a lamination structure having the meander line structure in the direction of the Y-axis, and such that the plurality of lamination structures are arranged in the direction of the X-axis and adjacent lamination structures are connected to each other in the direction of the X-axis to have the meander line structure; and a T-shaped assistant antenna device formed at an upper or lower dielectric layer in the main antenna device while being connected to one end of the main antenna device through a conductive via-hole so that the assistant antenna device dissipates current distribution of the main antenna device, thereby widening bandwidth.

2. The chip antenna as set forth in claim 1, wherein, each of the plurality of unit lamination structures comprises:

a plurality of conductive line patterns, each being formed with a conductive pattern having a predetermined length in the direction of the X-axis, on each of the dielectric layers laminated in the vertical direction inside the dielectric block; and a plurality of conductive via-holes for connecting the conductive line patterns adjacent to each other among the plurality of conductive line patterns in the vertical direction to have the meander line structure.

3. The chip antenna as set forth in claim 2, wherein the plurality of unit lamination structures are connected to each other in one lamination structure in such a manner that the adjacent unit lamination structures at one side of the unit lamination structure are connected to each other through one end of the lowermost conductive line pattern at one side thereof, and the adjacent lamination structures at the other side thereof are connected to each other through the other end of the uppermost conductive line pattern at the other side thereof.

4. The chip antenna as set forth in claim 1, wherein the plurality of lamination structures are connected to each other in such a manner that the adjacent lamination structures at one side of the lamination structure are connected to each other through the uppermost outer conductive line pattern at one side thereof, and the next adjacent lamination structures at the other side thereof are connected to each other through the lowermost outer conductive line pattern at the other side thereof.

5. The chip antenna as set forth in claim 1, wherein the assistant antenna device is formed on the dielectric layer at an upper or lower side of the main antenna device in the direction of the X-axis to have a predetermined length, and comprises:

a main pattern with one end of the main pattern connected to one end of the main antenna device through the conductive via-hole; and an assistant pattern formed of a plurality of patterns on the same dielectric layer as that of the main pattern, such that the plurality of patterns are spaced from each other by a predetermined distance, and connected with the main pattern in the direction perpendicular to the main pattern.

6. The chip antenna as set forth in claim 5, wherein the assistant pattern comprises the plurality of patterns having different lengths, respectively.

7. The chip antenna as set forth in claim 5, wherein the assistant pattern comprises the plurality of patterns having a length gradually decreased in the direction from one side of the main antenna device to the other side of the main antenna device, respectively.

8. The chip antenna as set forth in claim 5, wherein the assistant pattern comprises the plurality of patterns having a length gradually decreased from one end of the main pattern connected to one end of the main antenna device to the other end of the main pattern.

9. A chip antenna for terrestrial DMB, comprising:

a dielectric block with a plurality of dielectrics having an XY plane laminated in the direction of the Z-axis therein;

a main antenna device formed with conductive patterns to form meander line structures in the directions of the X-axis, the Y-axis and the Z-axis, respectively, in the dielectric block; and a T-shaped assistant antenna device formed at an upper or lower dielectric layer in the main antenna device while being connected to one end of the main antenna device through a conductive via-hole so that the assistant antenna device dissipates current distribution of the main antenna device, thereby widening bandwidth.

10. The chip antenna as set forth in claim 9, wherein the main antenna device has a resonance length corresponding to a frequency of the terrestrial DMB.

11. The chip antenna as set forth in claim 9, wherein the assistant antenna device comprises a plurality of patterns having a length gradually increasing from one side of the main antenna to the other side of the main antenna device, respectively.

* * * * *